US006867545B2

(12) United States Patent
Lee

(10) Patent No.: US 6,867,545 B2
(45) Date of Patent: Mar. 15, 2005

(54) PLASMA DISPLAY PANEL WITH LIGHT SHIELDING LAYERS HAVING DIFFERENT WIDTHS

(75) Inventor: Jae Hong Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/382,571

(22) Filed: Mar. 7, 2003

(65) Prior Publication Data

US 2003/0168978 A1 Sep. 11, 2003

(30) Foreign Application Priority Data

Mar. 8, 2002 (KR) ..... 10-2002-0012578

(51) Int. Cl.[7] ..... H01J 17/49

(52) U.S. Cl. ..... 313/582; 313/584; 313/590; 313/609; 313/613; 313/240

(58) Field of Search ..... 313/582, 584, 313/586, 587, 590, 609, 610, 613, 239, 240, 241

(56) References Cited

U.S. PATENT DOCUMENTS 5,754,003 A * 5/1998 Murai et al. ..... 313/582
6,034,474 A * 3/2000 Ueoka et al. ..... 313/584
6,411,032 B1 * 6/2002 Shiiki et al. ..... 313/582
6,512,499 B1 * 1/2003 Abe ..... 345/60
6,545,412 B1 * 4/2003 Jang ..... 313/587
6,611,099 B1 * 8/2003 Murata et al. ..... 313/582

FOREIGN PATENT DOCUMENTS

JP 2000-348627 A 12/2000
KR 2000-0067000 A 9/2000

* cited by examiner

*Primary Examiner*—Joseph Williams
*Assistant Examiner*—Kevin Quarterman
(74) *Attorney, Agent, or Firm*—Birch, Stewart, Kolasch & Birch, LLP

(57) ABSTRACT

The present invention relates to a plasma display panel that is adaptive for improving color temperature. A plasma display panel according to an embodiment of the present invention includes barrier ribs partitioning off each of the discharge cells; and a light-shielding layer formed along the barrier ribs, the width of the light-shielding layer is different for different discharge cells.

29 Claims, 10 Drawing Sheets

PLASMA DISPLAY PANEL WITH LIGHT SHIELDING LAYERS HAVING DIFFERENT WIDTHS

BACKGROUND OF THE INVENTION

1. Field of the Invention

The present invention relates to a plasma display panel, and more particularly to a plasma display panel that is adaptive for improving color temperature.

2. Description of the Related Art

A plasma display panel (hereinafter, PDP) is a display device using that visible ray is generated from phosphorus when vacuum ultraviolet ray generated by gas discharge excites the phosphorus.

The PDP has an advantage that it is thinner and lighter than a cathode ray tube CRT, and it can be made into a high definition large-scaled screen. The PDP includes a plurality of discharge cells arranged in a matrix, and each discharge cell becomes a pixel of a screen.

Referring to FIGS. 1 and 2, a discharge cell of a three AC surface discharge PDP in the related art includes a scan-sustain electrode 4Y and a common sustain electrode 4Z formed on an upper substrate 16, an address electrode 2X formed on a lower substrate 14. Herein, each of the sustain electrode pair 4Y and 4Z consist of a transparent electrode 4*a* and a bus electrode 4*b*.

There are deposited an upper dielectric layer 12 and a passivation film 10 on the upper substrate 16 where the scan-sustain electrode 4Y and the common sustain electrode 4Z. The upper dielectric layer 12 is formed in a multi-layer structure, e.g., there are formed a first and a second upper dielectric layer 12A and 12B. Wall charges generated upon a plasma discharge are accumulated on the upper dielectric layer 12.

The passivation film 10 prevents the damage of the upper dielectric layer 12 caused by a sputtering that is generated upon plasma discharge and at the same time the discharge efficiency of secondary electron. The passivation film 10 is generally magnesium oxide MgO.

There are formed a lower dielectric layer 18 and barrier ribs 8 on the lower substrate 14 provided with the address electrode 2X, and the surface of the lower dielectric layer 18 and the barrier ribs 8 is coated with a phosphorus layer 6. The address electrode 2X is formed crossing the scan-sustain electrode 4Y and common sustain electrode 4Z.

The barrier ribs 8 are formed parallel to the address electrode 2X to prevent the ultraviolet ray and visible ray generated by the discharge from being leaked to adjacent discharge cells.

The phosphorus layer 6 is formed on the barrier ribs 8 and the lower dielectric layer 18, and gets excited by the ultraviolet ray generated upon the plasma discharge to generate any one of red, green and blue visible rays R, G and B.

There is injected an inert gas for gas discharge into a discharge space provided between the upper substrate 16, the lower substrate 14 and the barrier ribs 8.

In the PDP, there is formed a light-shielding layer 20 between the first upper dielectric layer 12A and the second dielectric layer 12B along the barrier ribs 8 in a direction of crossing the sustain electrode pair 4Y and 4Z in order to minimize the interference between adjacent discharge cells and to improve the contrast of a screen at the same time. Or, there is formed a light-shielding layer 22, as shown in FIG. 3, between the scan-sustain electrode 4Y and the common sustain electrode 4Z, which are formed in each of the discharge cells adjacent to each other, in a direction of crossing the barrier ribs 8.

The discharge cell with such a structure is selected by the opposite discharge between the address electrode 2X and the scan-sustain electrode 4Y, then sustains the discharge by a surface discharge between the sustain electrode pair 4Y and 4Z. In the discharge cell, the ultraviolet ray generated upon the sustain discharge causes the phosphorus 6 to emit the visible light to the outside of the cell, thereby displaying a picture.

The related art PDP have discharge cells realizing red, green and blue of a specific width with the barrier ribs 8 therebetween. The luminescent brightness of the discharge cells, which realize red R, green G and blue B, is different due to the luminescent characteristic of the phosphorus layer 6 of red R, green G and blue B, which are different from each other. Specifically, the luminescent brightness of the discharge cell, which realizes green G, is higher than those of the discharge cells, which realize red R and blue B, and the luminescent brightness of the discharge cell, which realizes red R, is higher than that of the discharge cell, which realizes and blue B. In this case, there is a problem that the color temperature of the PDP on the whole is lowered due to the low luminescent brightness of the discharge cell, which realizes blue B.

In order to solve the problem like this, the PDP with asymmetric barrier rib structure is proposed as shown in FIG. 4.

Referring to FIG. 4, the PDP with asymmetric barrier rib 26 structure has a discharge cell 28R realizing red R, a discharge cell 28G realizing green G and a discharge cell 28B realizing blue B formed to have different width from one another, thereby controlling the color temperature. In other words, the area of the discharge cell 28B realizing blue B, the luminescent brightness of which is the lowest, is formed to be the biggest, and the area of the discharge cell 28R of red R, the influence of which is the lowest on the whole brightness and color temperature, is formed to be the smallest. For example, the ratio of the area of red, green and blue discharge cells 28G, 28G and 28B is 0.8:1:2.2.

However, when coating the red, green and blue discharge cells 28R, 28G and 28B of different width, the mask and process condition for phosphorus coating get different by red, green and blue discharge cells 28R, 28G and 28B to make the operation difficult.

SUMMARY OF THE INVENTION

Accordingly, it is an object of the present invention to provide a plasma display panel that is adaptive for improving color temperature.

In order to achieve these and other objects of the invention, a plasma display panel according to an aspect of the present invention includes barrier ribs partitioning off each of the discharge cells; and a light-shielding layer formed along the barrier ribs, the width of the light-shielding layer is different in accordance with the discharge cell.

Herein, the barrier ribs are formed parallel to the lower plate electrodes of the discharge cells, to which data are applied.

Herein, the light-shielding layer is formed, so that the effective luminescence area of at least any one of the red, green and blue discharge cells is made different.

Herein, the effective luminescence area of the blue discharge cell is formed bigger than that of the red and green discharge cells, and the effective luminescence areas of the red and green discharge cells are the same.

Herein, the effective luminescence area of the blue discharge cell is formed bigger than that of the red and green discharge cells, and the effective luminescence area of the red discharge cell is formed bigger than that of the green discharge cell.

Herein, one side of the light-shielding layer is identical to one side of the barrier ribs, and the other side of the light-shielding layer is extended toward the discharge cell.

Herein, one side of the light-shielding layer is formed for one side of the barrier ribs to be exposed, and the other side of the light-shielding layer is extended toward the discharge cell area.

Herein, the plasma display panel further includes a first and a second dielectric layer formed on the upper plate electrode; and a passivation film formed on the first and second dielectric layer.

Herein, the light-shielding layer is formed on any one of the first dielectric layer, the second dielectric layer and the passivation film.

Herein, the plasma display panel further includes a reflection layer formed between the barrier ribs and the light-shielding layer to overlap the light-shielding layer.

A plasma display panel according to another aspect of the present invention includes barrier ribs partitioning off each of the discharge cells; and a light-shielding layer formed along the barrier ribs in relation with the upper electrode, the width of the light-shielding layer is different in accordance with the discharge cell.

Herein, the barrier ribs are formed parallel to the lower plate electrodes of the discharge cells, to which data are applied.

Herein, the upper plate electrode includes a transparent electrode formed of transparent conductive material; and a bus electrode formed of a first and a second bus electrode material on the transparent electrode.

Herein, the light-shielding layer and any one of the first and second bus electrode materials are simultaneously formed of the same material.

Herein, the light-shielding layer is formed, so that the effective luminescence area of at least any one of the red, green and blue discharge cells is made different.

Herein, the effective luminescence area of the blue discharge cell is formed bigger than that of the red and green discharge cells, and the effective luminescence areas of the red and green discharge cells are the same.

Herein, the effective luminescence area of the blue discharge cell is formed bigger than that of the red and green discharge cells, and the effective luminescence area of the red discharge cell is formed bigger than that of the green discharge cell.

A plasma display panel according to still another aspect of the present invention includes barrier ribs partitioning off each of the discharge cells; a first light-shielding layer formed along the barrier ribs, the width of the first light-shielding layer is different in accordance with the discharge cell; and a second light-shielding layer formed between adjacent discharge cells to cross the first light-shielding layer.

Herein, the barrier ribs are formed parallel to the lower plate electrodes of the discharge cells, to which data are applied.

Herein, the light-shielding layer is formed, so that the effective luminescence area of at least any one of the red, green and blue discharge cells is made different.

Herein, the effective luminescence area of the blue discharge cell is formed bigger than that of the red and green discharge cells, and the effective luminescence areas of the red and green discharge cells are the same.

Herein, the effective luminescence area of the blue discharge cell is formed bigger than that of the red and green discharge cells, and the effective luminescence area of the red discharge cell is formed bigger than that of the green discharge cell.

A plasma display panel according to still another aspect of the present invention includes barrier ribs partitioning off each of the discharge cells; a first light-shielding layer formed along the barrier ribs in relation with the upper plate electrode, the width of the first light-shielding layer is different in accordance with the discharge cell; and a second light-shielding layer formed between adjacent discharge cells to cross the first light-shielding layer.

Herein, the barrier ribs are formed parallel to the lower plate electrodes of the discharge cells, to which data are applied.

Herein, the upper plate electrode includes a transparent electrode formed of transparent conductive material; and a bus electrode formed of a first and a second bus electrode material on the transparent electrode.

Herein, the light-shielding layer and any one of the first and second bus electrode materials are simultaneously formed of the same material.

Herein, the light-shielding layer is formed, so that the effective luminescence area of at least any one of the red, green and blue discharge cells is made different.

Herein, the effective luminescence area of the blue discharge cell is formed bigger than that of the red and green discharge cells, and the effective luminescence areas of the red and green discharge cells are the same.

Herein, the effective luminescence area of the blue discharge cell is formed bigger than that of the red and green discharge cells, and the effective luminescence area of the red discharge cell is formed bigger than that of the green discharge cell.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 5 to 10, embodiments of the present invention will be explained as follows.

Figure 1:
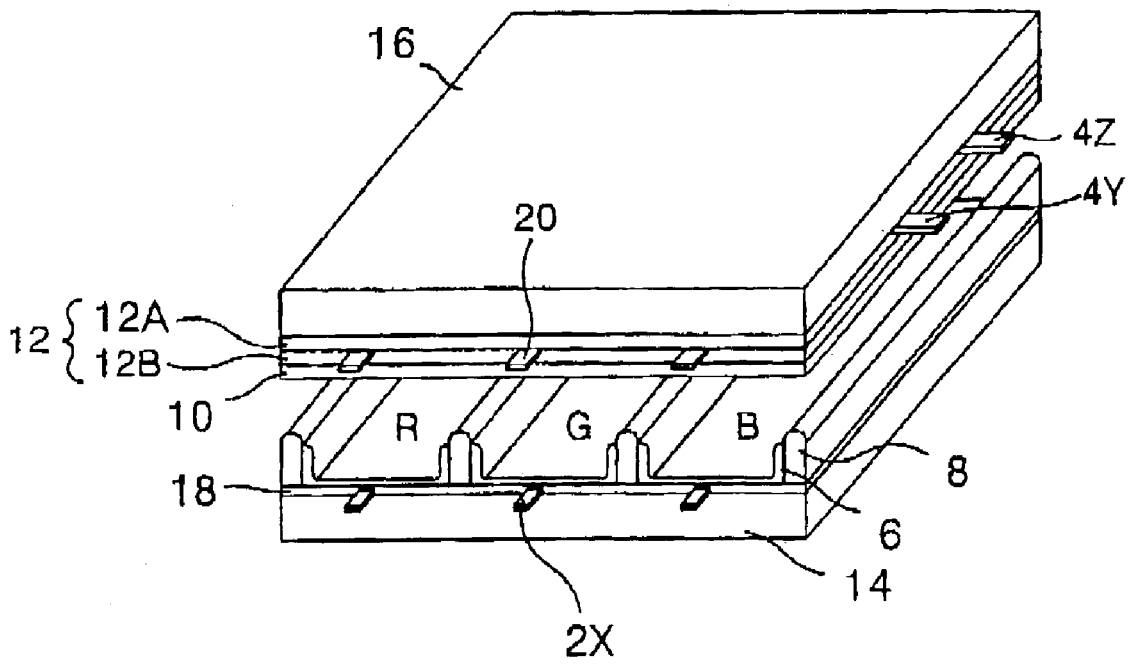
FIG. 1 RELATED ART
FIG. 1 is a prospective view representing a related art plasma display panel.
Figure 2:
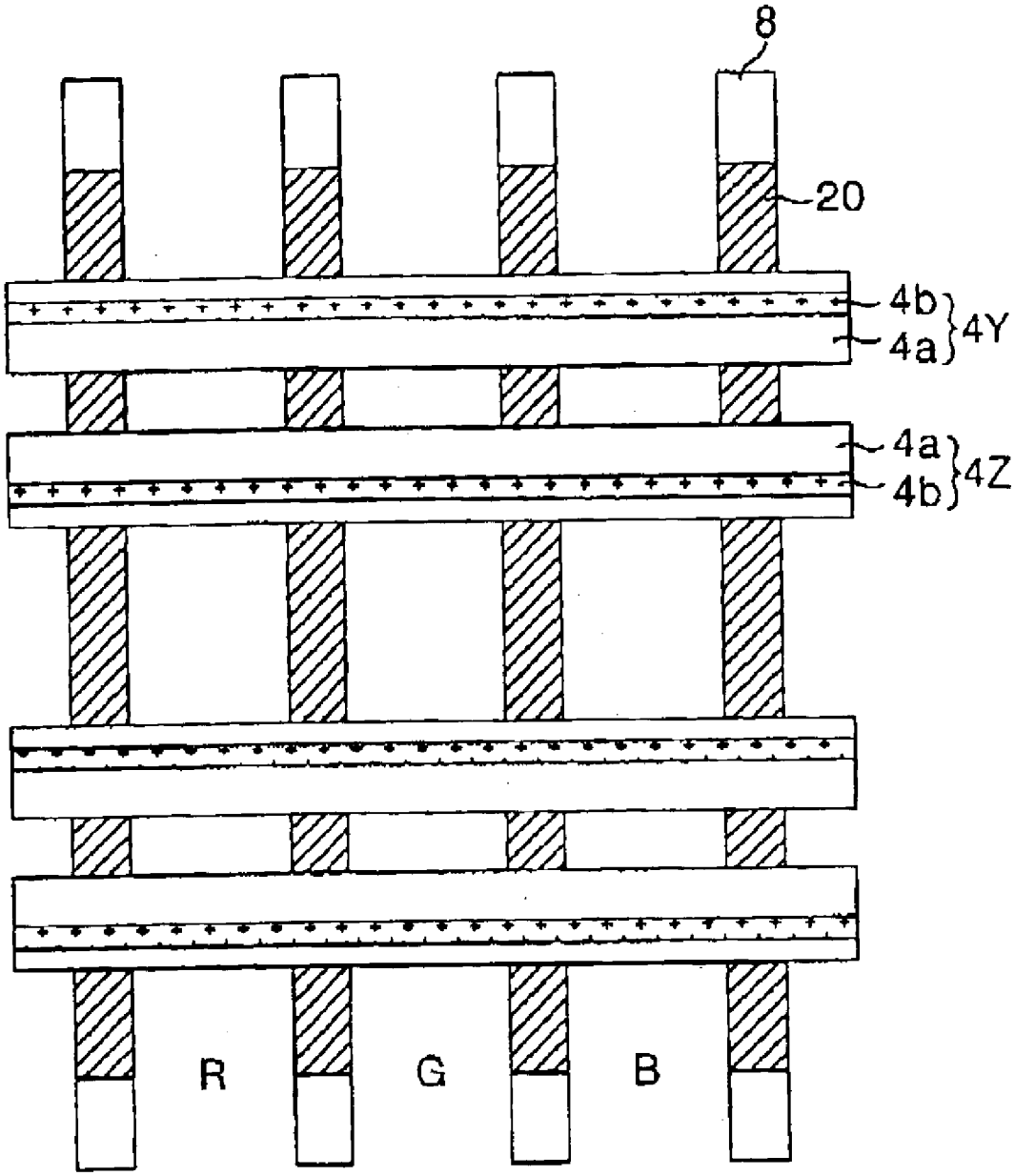
FIG. 2 RELATED ART
FIG. 2 is a plan view representing the plasma display panel shown in FIG. 1.
Figure 3:
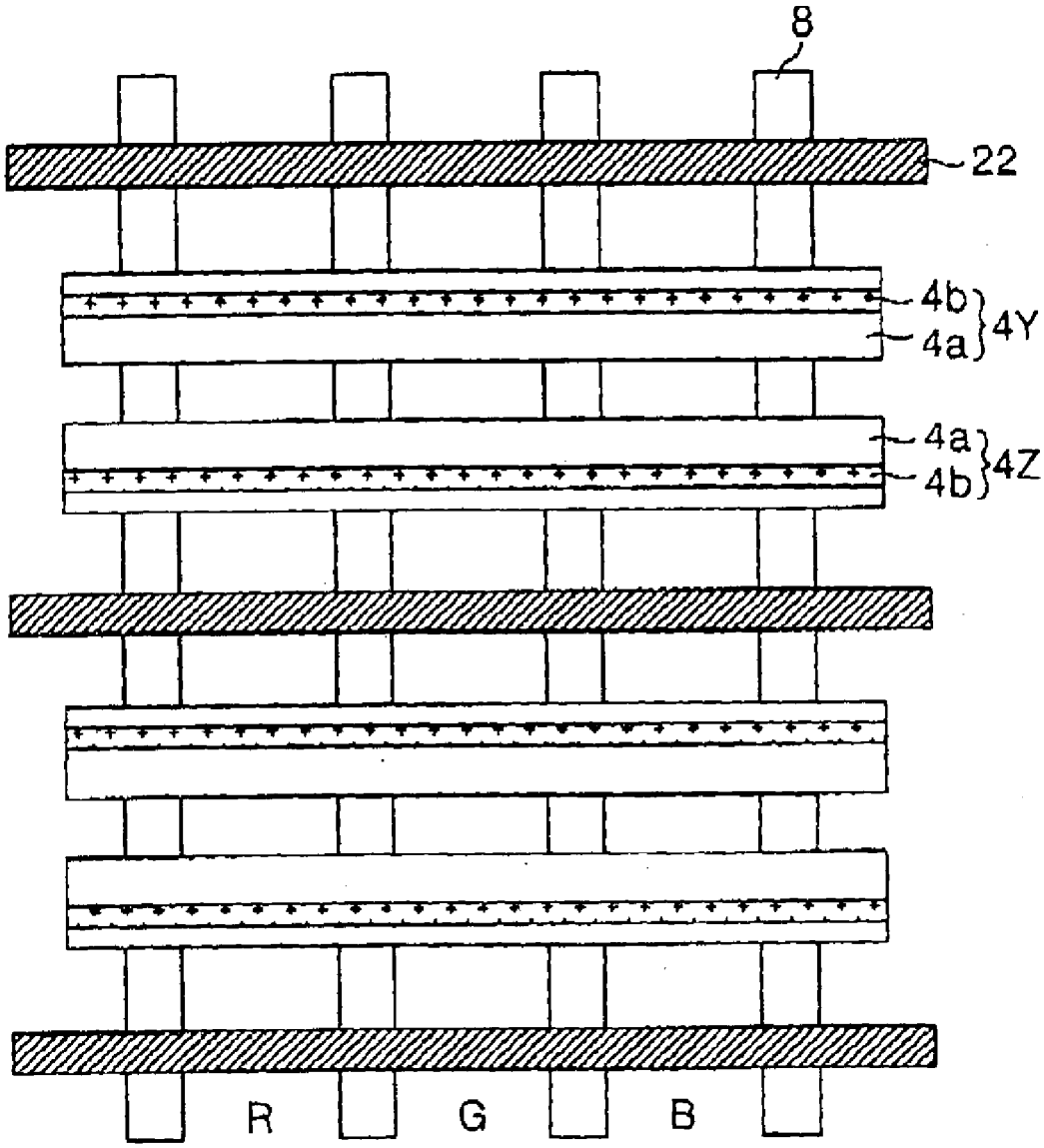
FIG. 3 RELATED ART
FIG. 3 is a plan view representing another light-shielding layer of the related art plasma display panel.
Figure 4:
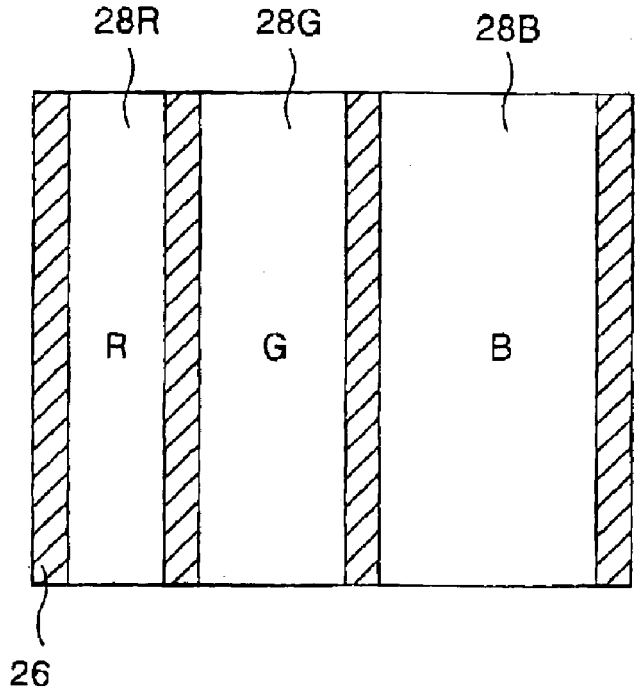
FIG. 4 RELATED ART
FIG. 4 is a plan view representing another plasma display panel where a width is different for each related art discharge cell.
Figure 5:
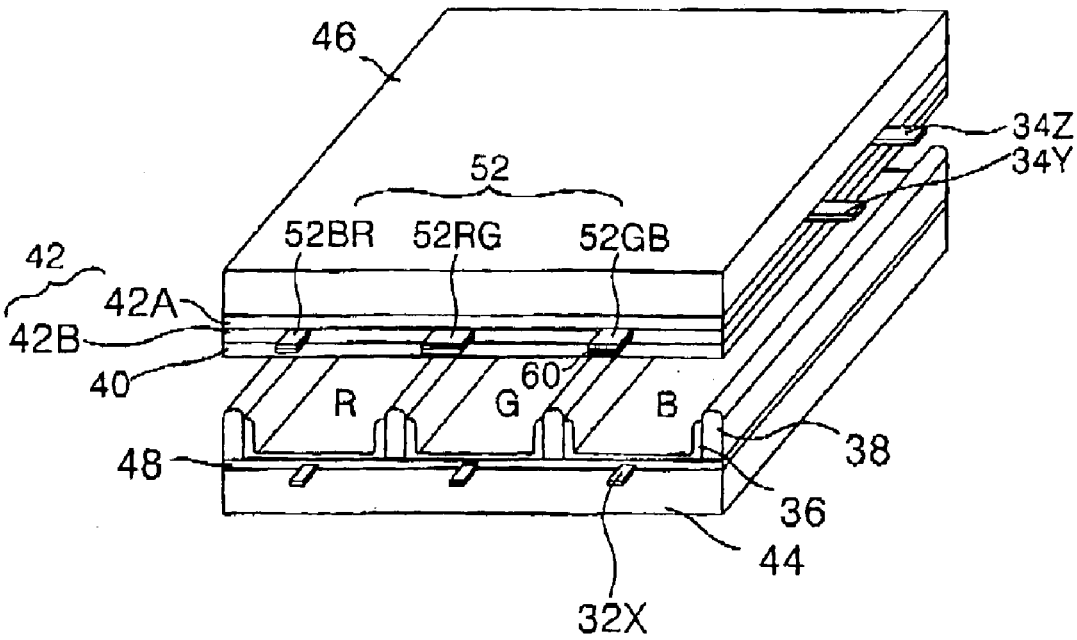
FIG. 5 is a perspective view representing a plasma display panel according to the first embodiment of the present invention.
Figure 6:
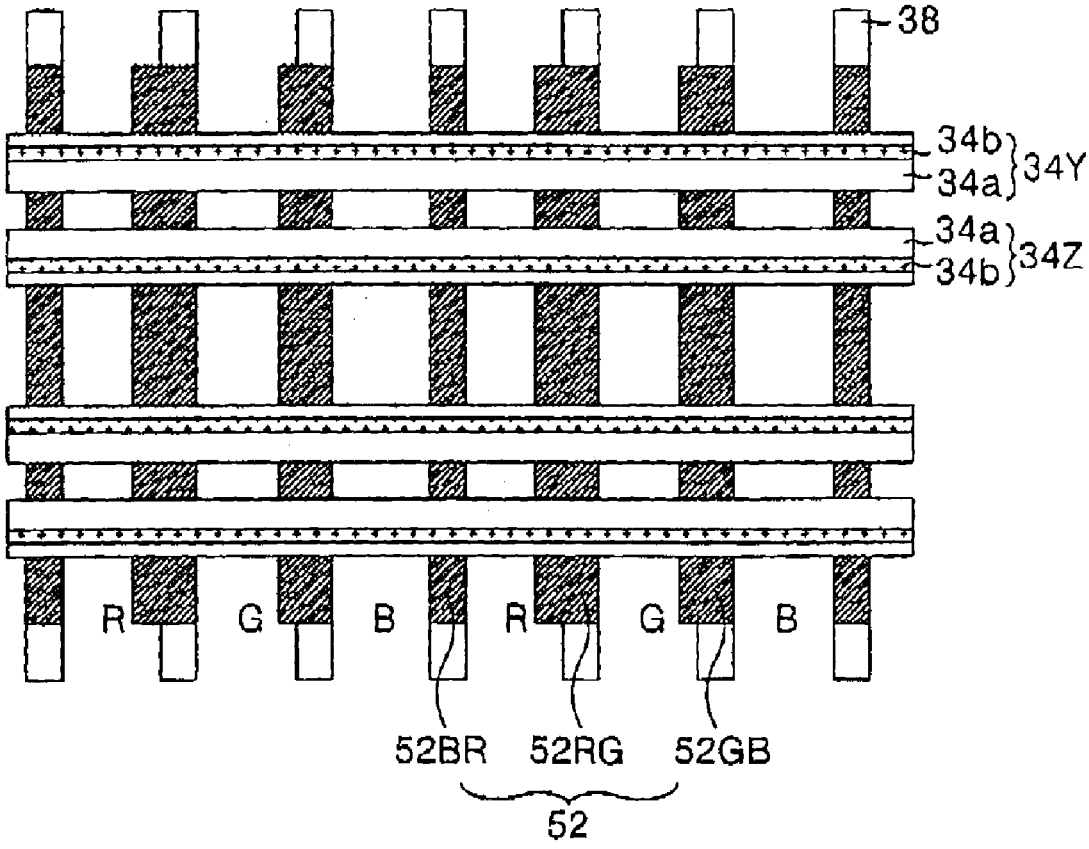
FIG. 6 is a plan view representing the plasma display panel shown in FIG. 5.

FIG. 5 is a perspective view representing a plasma display panel according to the first embodiment of the present invention. FIG. 6 is a plan view representing the plasma display panel shown in FIG. 5.

Referring to FIGS. 5 and 6, a discharge cell of PDP according to the first embodiment of the present invention includes a scan-sustain electrode 34Y and a common sustain electrode 34Z formed on an upper substrate 46, an address electrode 32X formed on a lower substrate 44. Herein, each of the sustain electrode pair 34Y and 34Z consist of a transparent electrode 34A and a bus electrode 34B.

There are deposited an upper dielectric layer 42 and a passivation film 40 on the upper substrate 46 where the scan-sustain electrode 34Y and the common sustain electrode 34Z. The upper dielectric layer 42 is formed in a multi-layer structure, e.g., there are formed a first and a second upper dielectric layer 42A and 42B. Wall charges generated upon a plasma discharge are accumulated on the upper dielectric layer 42.

The passivation film 40 prevents the damage of the upper dielectric layer 42 caused by a sputtering that is generated upon plasma discharge and at the same time increases the discharge efficiency of secondary electron. The passivation film 40 is generally magnesium oxide mgO.

There are formed a lower dielectric layer 48 and barrier ribs 38 on the lower substrate 44 provided with the address electrode 32X, and the surface of the lower dielectric layer 48 and the barrier ribs 38 is coated with a phosphorus layer 36. The address electrode 32X is formed crossing the scan-sustain electrode 34Y and common sustain electrode 34Z.

The barrier ribs 38 are formed parallel to the address electrode 32X to prevent the ultraviolet ray and visible ray generated by the discharge from being leaked to adjacent discharge cells.

The phosphorus layer 36 gets excited by the ultraviolet ray generated upon the plasma discharge to generate any one of red, green and blue visible rays R, G and B.

There is injected an inert gas for gas discharge into a discharge space provided between the upper substrate 46, the lower substrate 44 and the barrier ribs 38.

There is formed a light-shielding layer 52 between the first upper dielectric layer 42A and the second upper dielectric layer 42B of such a PDP in a perpendicular direction to the sustain electrode pair 34Y and 34Z in order to improve the contrast of the screen. The light-shielding layer 52 includes a first light-shielding layer 52BR located between red R and blue B discharge cells, a second light-shielding layer 52 RG located between red R and green G discharge cells, and a third light-shielding layer 52 GB located between green G and blue B discharge cells. One side of each of the first to third light-shielding layers 52BR, 52RG and 52 GB is formed to be identical to one side of the barrier ribs 38, or to be within the one side of the barrier ribs 38 to expose part of the one side of the barrier ribs 38.

The first and third light-shielding layers 52BR, 52RG and 52GB each have different width in accordance with the corresponding discharge cell. In other words, the first and third light-shielding layers 52BR, 52RG and 52GB control to make the width of discharge cells in the order of the blue B, green G and red R discharge cells, wherein the blue G discharge cell is the widest. Accordingly, the light-shields are formed to have their width in the order of the first light-shielding layer 52RB, the second light-shielding layer 52GS and the third light-shielding layer 52RG. For example, the first light-shield layer 52BR is 65 $\mu$m, the second light-shield layer 52GB is 75 $\mu$m, and the third light-shield layer 52RG is 85 $\mu$m.

More specifically explaining this, the first light-shielding layer 52BR located between the blue B discharge cell and the red R discharge cell is formed to have the same width as the barrier ribs 38 partitioning off the red R and blue B discharge cells.

The second light-shielding layer 52GB located between the green G discharge cell and the blue B discharge cell is formed to have relatively wider width than the first light-shielding layer 52BR. In other words, the second light-shielding layer 52GB has its one side identical to the one side of the barrier ribs 38 adjacent to the blue B discharge cell and the other side extended toward the green G discharge cell to cover part of the green G discharge cell.

The third light-shielding layer 52RG located between the green G discharge cell and the red R discharge cell is formed to have relatively wider width than the second light-shielding layer 52GB. In other words, the third light-shielding layer 52RG has its one side identical to the one side of the barrier ribs 38 adjacent to the green G discharge cell and the other side extended toward the red R discharge cell to cover part of the red R discharge cell.

On the other hand, there is formed a reflection layer 60 between the light-shielding layer 52 and the barrier ribs 38 in order to reflect back to the inside of the discharge cell the light intercepted by the first to the third light-shielding layer 52BR, 52RG and 52GB, the width of which is wider than that of the barrier ribs 38.

The reflection layer 60 is formed at the lower part of the light-shielding layer 52 between the first upper dielectric layer 42A and the second upper dielectric layer 42B, at the lower part of the second upper dielectric layer 42B, or at the lower part of the upper passivation film 40. The reflection layer 60 is formed of chrome Cr or titanium oxide $TiO_2$ to have the same width as the first to third light-shielding layers 52BR, 52G3 and 52RG. Such a reflection layer 60 reflects the light intercept by the first to third light-shielding layers 52BR, 52GB and 52RG back to the inside of the discharge cell to act to illuminated the reflected light by the barrier ribs 38, the phosphorus 36 or the lower dielectric layer 48 to the outside.

A fabricating method of an upper plate of a PDP according to the first embodiment of the present invention is described as follows. Firstly, there is formed the transparent electrode 34A by depositing a transparent conductive material on the upper substrate 46 and patterning the deposited material. There is formed the bus electrode 34B by depositing a bus electrode material on the upper substrate 46 provided with the transparent electrode 34A and patterning the deposited material. Accordingly, there are formed a pair of sustain electrodes consisting of the scan-sustain electrode 34Y and the common sustain electrode 34Z. There is formed the light-shielding layer 52 on the first upper dielectric layer 42A to cross the sustain electrode pair 34Y and 34Z after forming the first upper dielectric layer 42A on the upper substrate 46 provided with the sustain electrode pair 34Y and 34Z. The upper plate is completed after the second upper dielectric layer 42B and the passivation film 40 are sequentially formed on the first upper dielectric layer 42A provided with the light-shielding layer 52. The completed upper plate is bonded together with the lower plate provided with the address electrode 32X, the lower dielectric layer 48, the barrier ribs 38 and the phosphorus layer 36, resulting in the completion of the PDP.

In this way, in the PDP and the fabricating method thereof according to the first embodiment of the present invention, the first to third light-shielding layers 52BR, 52GB, 52RG have their one side identical to one side of the barrier ribs 38. Accordingly, an area near to the upper part of the barrier ribs, where the amount of light emission by the ultraviolet is relatively big, is not blocked by the first to third light-shielding layers 52BR, 52GB, 52RG, thus the deterioration of the brightness of the PDP can be minimized. The brightness deterioration occurring in this area can compensate brightness decrement to some degree because there is no light-shielding layer between the scan-sustain electrode and the common sustain electrode of the discharge cell, which used to have the light-shielding layer in the related art. Further, the first to third light-shielding layers 52BR, 52GB, 52RG with their width different from one another have different areas from one another, wherein the areas cover the phosphorus layer 36 in the upper part of the barrier ribs 38, thus the amount of light emission can be controlled by red r, green G and blue B phosphorus layer 36 and the color temperature can be controlled.

Figure 7:
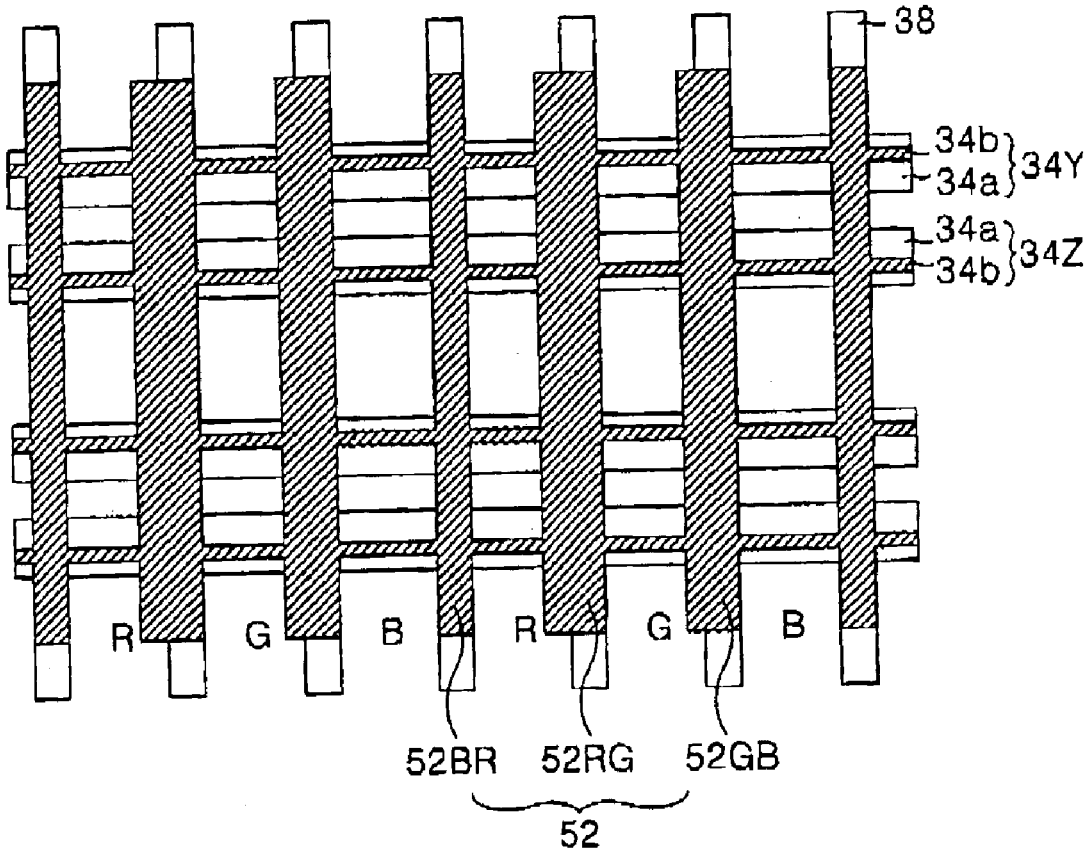
FIG. 7 is a perspective view representing a plasma display panel according to the second embodiment of the present invention.

FIG. 7 is a plan view representing a PDP according to the second embodiment of the present invention.

Referring to FIG. 7, the PDP according to the second embodiment of the present invention include the same components except that a light-shielding layer 52 and a black layer included in a bus electrode 34B as compared with the PDP shown in FIGS. 5 and 6.

The light-shielding layer 52 according to the second embodiment of the present invention is formed in a perpendicular direction to the sustain electrode pair 34Y and 34Z in order to improve the contrast of the screen. The light shielding layer 52 is formed of the same metal as the bus electrode 34B constituting the sustain electrode pair 34Y and 34Z.

The sustain electrode pair 34Y and 34Z includes the scan-sustain electrode 34Y and the common sustain electrode 34Z, each of which is consisting of the transparent electrode 34A and the bus electrode 34B.

The transparent electrode 34A is formed of a transparent conductive material. The bus electrode 34B is formed on the transparent electrode 34A, consisting of a first and a second metal layer. The first metal layer is a black layer that has a weak conductivity, e.g., ruthenium oxide, and is formed together with the light-shielding layer 52 at the same time. The second metal layer is silver Ag.

The fabricating method of the light-shielding layer shown in FIG. 7 will be explained in connection with FIGS. 8A to 8D.

Figure 8A:
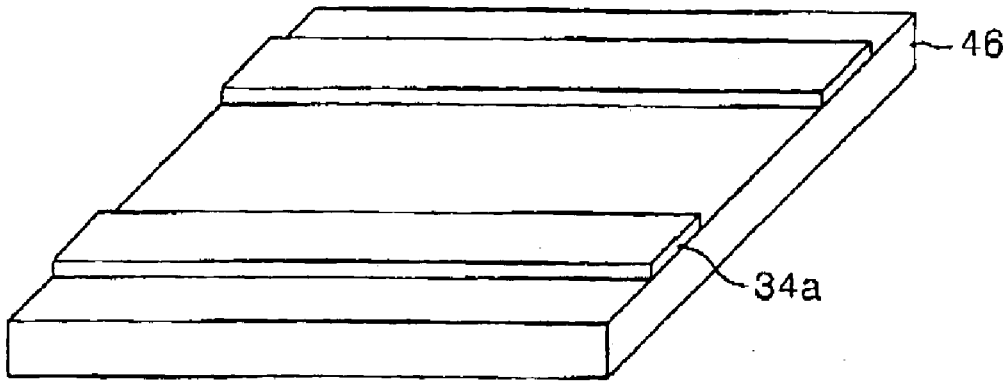
FIGS. 8A to 8D are sectional views representing a fabricating method of a light-shielding layer shown in FIG. 7 step by step.
Figure 8B:
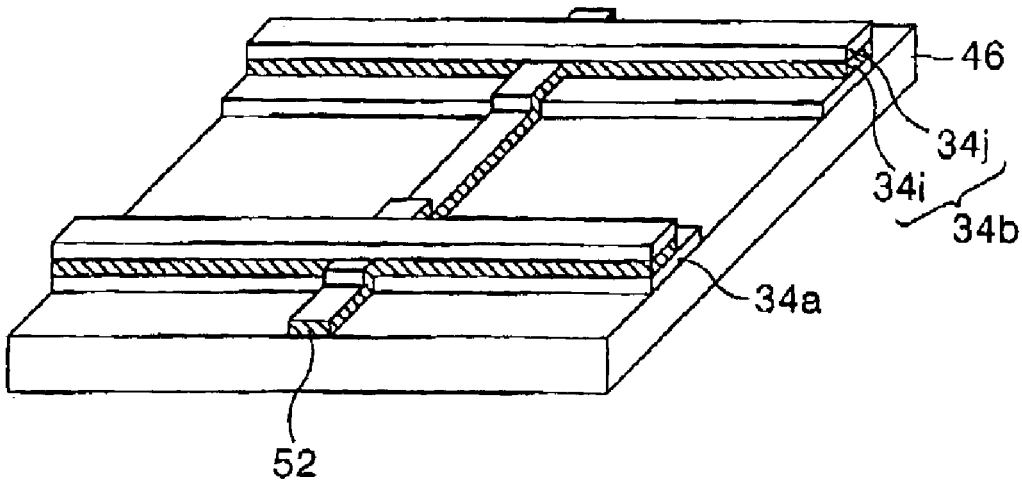

Firstly, there is formed, as shown in FIG. 8A, the transparent electrode 34A by depositing a transparent conductive material on the upper substrate 46 and patterning the deposited material. There are simultaneously formed, as shown in FIG. 8B, the bus electrode 34B and the light-shielding layer 52 by depositing the black layer 34*i* with weak conductivity, e.g., ruthenium oxide, and silver 34*j* on the upper substrate 46 provided with the transparent electrode 34A and patterning the deposited material. Herein, the bus electrode 34B and the transparent electrode 34A are used as the sustain electrode pair 34Y and 34Z.

Figure 8C:
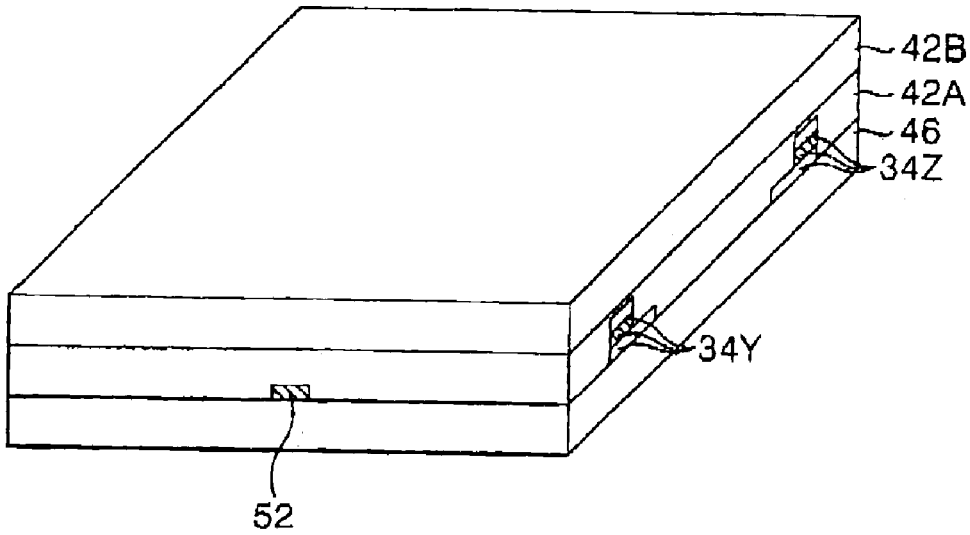
Figure 8D:
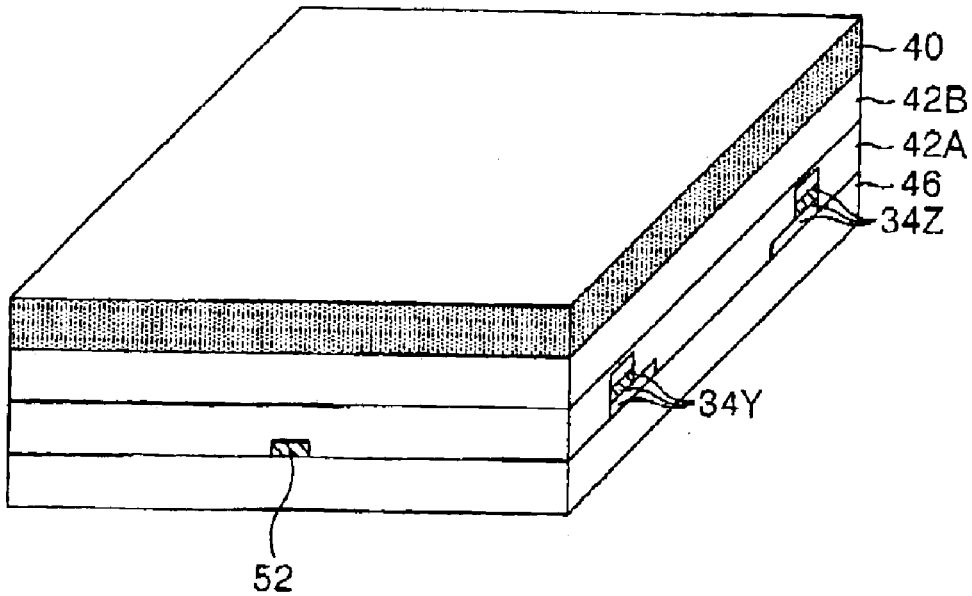

There are formed, as shown in FIG. 8C, the first and second upper dielectric layer 42A and 42B by sequentially depositing a first and a second dielectric material on the upper substrate 46 provided with the sustain electrode pair 34Y, 34Z and the light-shielding layer 52. And then, there is formed, as shown in FIG. 8D, the passivation film 40 by coating the second upper dielectric layer 42B with magnesium oxide MgO.

In this way, in the PDP and the fabricating method thereof according to the second embodiment of the present invention, the first to third light-shielding layers 52BR, 52GB, 52RG have their one side identical to one side of the barrier ribs 38. Accordingly, an area near to the upper part of the barrier ribs, where the amount of light emission by the ultraviolet is relatively big, is not blocked by the first to third light-shielding layers 52BR, 52GB, 52RG, thus the deterioration of the brightness of the PDP can be minimized. The brightness deterioration occurring in this area can compensate brightness decrement to some degree because there is no light-shielding layer between the scan-sustain electrode and the common sustain electrode of the discharge cell, which used to have the light-shielding layer in the related art. Further, the first to third light-shielding layers 52BR, 52GB, 52RG with their width different from one another have different areas from one another, wherein the areas cover the phosphorus layer 36 in the upper part of the barrier ribs 38, thus the amount of light emission can be controlled by red r, green G and blue B phosphoruses 36 and the color temperature can be controlled. In addition, the light-shielding layer 52 and the black layer 34*i* of the bus electrode are formed at the same time, so that the process can be simplified.

Figure 9:
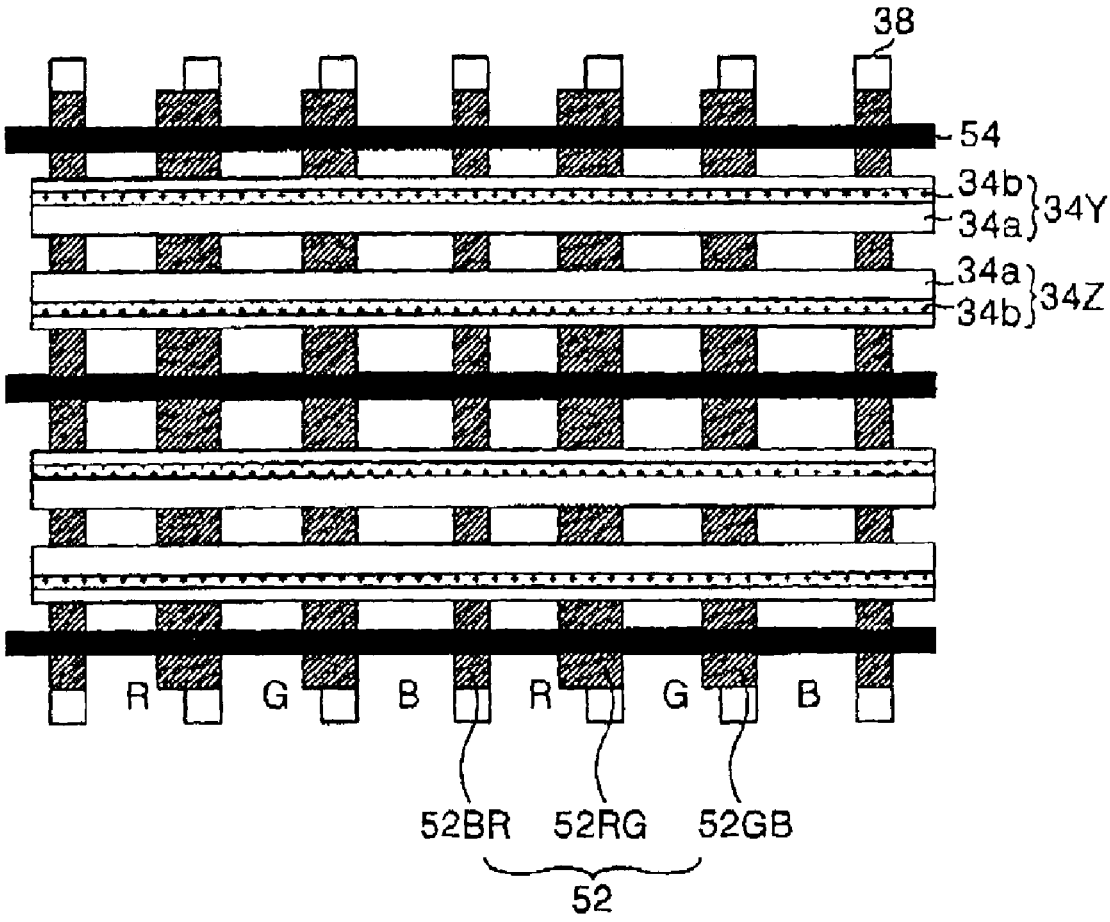
FIG. 9 is a perspective view representing a plasma display panel according to the third embodiment of the present invention.

FIG. 9 is a plan view representing a PDP according to the third embodiment of the present invention.

Referring to FIG. 9, the POP according to the third embodiment of the present invention include the same components except for a further added horizontal light-shielding layer 54 parallel to the sustain electrode pair 34Y and 34Z as compared with the PDP shown in FIGS. 5 and 6.

The light-shielding layer according to the third embodiment of the present invention includes a vertical light-shielding layer 52 formed to overlap the barrier ribs 38, and a horizontal light-shielding layer 54 formed between the scan-sustain electrode 34Y and the common sustain electrode 34Z of the adjacent discharge cells.

The vertical light-shielding layer 52 and the horizontal light-shielding layer 54 are simultaneously formed on at least any one of the first and second upper dielectric layers 42A and 42B, or on the passivation film 40.

In this way, in the PDP according to the third embodiment of the present invention, the first to third light-shielding layers 52BR, 52GB, 52RG have their one side identical to one side of the barrier ribs 38. Accordingly, an area near to the upper part of the barrier ribs, where the amount of light emission by the ultraviolet is relatively big, is not blocked by the first to third light-shielding layers 52BR, 52GB, 52RG, thus the deterioration of the brightness of the POP can be minimized. Further, the first to third light-shielding layers 52BR, 52GB, 52RG with their width different from one another have different areas from one another, wherein the areas cover the phosphorus 36 in the upper part of the barrier ribs 38, thus the amount of light emission can be controlled by red r, green G and blue B phosphoruses 36 and the color temperature can be controlled. In addition, the vertical light-shielding layer 52 and the horizontal light-shielding layer 54 are formed to improve the contrast.

Figure 10:
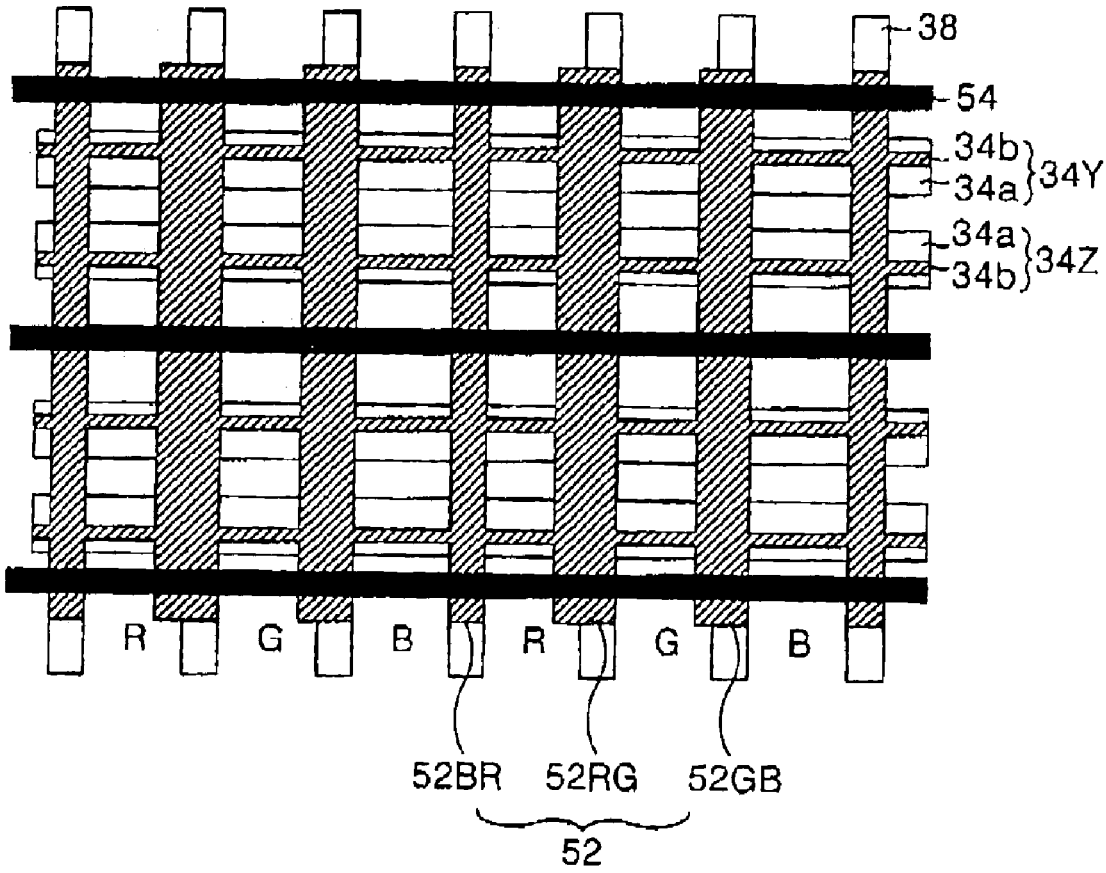
FIG. 10 is a perspective view representing a plasma display panel according to the fourth embodiment of the present invention.

FIG. 10 is a plan view representing a PDP according to the fourth embodiment of the present invention.

Referring to FIG. 10, the PDP according to the fourth embodiment of the present invention include the same components except that the vertical light-shielding layer 52 is formed on the same layer as the black layer included in the bus electrode and there is further added a horizontal light-shielding layer 54 parallel to the sustain electrode pair 34Y and 34Z as compared with the PDP shown in FIGS. 5 and 6.

The vertical light-shielding layer 52 and the horizontal light-shielding layer 54 according to the third embodiment of the present invention are formed to improve the contrast of the screen.

The vertical light-shielding layer 52 is formed in a perpendicular direction to the sustain pair 34Y and 34Z, and is simultaneously formed of the same metal as the bus electrode consisting of the first and second metal layers, which are the sustain metal pair 34Y and 34Z. The First metal layer is simultaneously formed along with the light-shielding layer 52 and is the black layer of weak conductivity, e.g., ruthenium oxide, and the second metal layer is silver Ag.

The horizontal light-shielding layer 54 is formed between the scan-sustain electrode 34Y and the common sustain electrode 34Z of the adjacent discharge cells.

The vertical light-shielding layer 52 and the horizontal light-shielding layer 54 can be simultaneously formed on the same layer or can be formed separately.

In this way, in the PDP according to the fourth embodiment of the present invention, the first to third light-shielding layers 52BR, 52GB, 52RG have their one side identical to one side of the barrier ribs 38. Accordingly, an area near to the upper part of the barrier ribs, where the amount of light emission by the ultraviolet is relatively big, is not blocked by the first to third light-shielding layers 52BR, 52GB, 52RG, thus the deterioration of the brightness of the PDP can be minimized. Further, the first to third light-shielding layers 52BR, 52GB, 52RG with their width different from one another have different areas from one another, wherein the areas cover the phosphorus 36 in the upper part of the barrier ribs 38, thus the amount of light emission can be controlled by red r, green G and blue B phosphoruses 36 and the color temperature can be controlled. In addition, the vertical light-shielding layer 52 and the horizontal light-shielding layer 54 are formed to improve the contrast.

As described above, in the plasma display panel according to the present invention, the width of the light-shielding layer is formed differently to make the area of the discharge cell in the order of the red, green and blue discharge cells, wherein the red discharge cell has the smallest. Accordingly, the amount of light emission can be controlled by red, green and blue phosphoruses and the color temperature can be controlled as well. Further, the brightness deterioration can be minimized because the amount of light emission by the ultraviolet ray is increased more at the area close to the upper area of the barrier ribs than other areas by forming the light-shielding layer to be identical to one side of the barrier ribs.

Although the present invention has been explained by the embodiments shown in the drawings described above, it should be understood to the ordinary skilled person in the art that the invention is not limited to the embodiments, but rather that various changes or modifications thereof are possible without departing from the spirit t of the invention. Accordingly, the scope of the invention shall be determined only by the appended claims and their equivalents.

What is claimed is:

1. A plasma display panel having a plurality of lower plate electrodes and a plurality of upper plate electrodes and having red, green and blue discharge cells arranged at intersections of the lower plate electrodes and the upper plate electrodes, the plasma display panel comprising:

barrier ribs partitioning off each of the discharge cells; and a light shielding layer formed along the barrier ribs, the width of the light shielding layer being different for different discharge cells.

2. The plasma display panel according to claim 1, wherein the barrier ribs are formed parallel to the lower plate electrodes of the discharge cells, to which data are applied.

3. The plasma display panel according to claim 1, wherein the light-shielding layer is formed, so that the effective luminescence area of at least any one of the red, green and blue discharge cells is different from the luminescence area of at least another of the red, green and blue discharge cells.

4. The plasma display panel according to claim 3, wherein the effective luminescence area of the blue discharge cell is formed bigger than that of the red and green discharge cells, and the effective luminescence areas of the red and green discharge cells are the same.

5. The plasma display panel according to claim 3, wherein the effective luminescence area of the blue discharge cell is formed bigger than that of the red and green discharge cells, and the effective luminescence area of the red discharge cell is formed bigger than that of the green discharge cell.

6. The plasma display panel according to claim 1, wherein one side of the light-shielding layer coincides with one side of the barrier ribs, and the other side of the light-shielding layer is extended toward the discharge cells.

7. The plasma display panel according to claim 1, wherein one side of the light-shielding layer is formed for one side of the barrier ribs to be exposed, and the other side of the light-shielding layer is extended toward the area of the discharge cells.

8. The plasma display panel according to claim 1, further comprising:

a first and a second dielectric layer formed on the upper plate electrode; and a passivation film formed on the first and second dielectric layer.

9. The plasma display panel according to claim 8, wherein the light-shielding layer is formed on any one of the first dielectric layer, the second dielectric layer and the passivation film.

10. The plasma display panel according to claim 1, further comprising:

a reflection layer formed between the barrier ribs and the light-shielding layer to overlap the light-shielding layer.

11. A plasma display panel having a plurality of lower plate electrodes and a plurality of upper plate electrodes and having red, green and blue discharge cells arranged at intersections of the lower plate electrodes and the upper plate electrodes, the plasma display panel comprising:

barrier ribs partitioning off each of the discharge cells; and a light-shielding layer formed along the barrier ribs in relation with the upper electrode, the width of the light-shielding layer being different for different discharge cells.

12. The plasma display panel according to claim 11, wherein the barrier ribs are formed parallel to the lower plate electrodes of the discharge cells, to which data are applied.

13. The plasma display panel according to claim 11, wherein the upper plate electrode includes:

a transparent electrode formed of transparent conductive material; and a bus electrode formed of a first and a second bus electrode material on the transparent electrode.

14. The plasma display panel according to claim 13, wherein the light-shielding layer and any one of the first and second bus electrode materials are simultaneously formed of the same material.

15. The plasma display panel according to claim 11, wherein the light-shielding layer is formed, so that the effective luminescence area of at least any one of the red, green and blue discharge cells is different from the luminescence area of at least another of the red, green and blue discharge cells.

16. The plasma display panel according to claim 15, wherein the effective luminescence area of the blue discharge cell is formed bigger than that of the red and green discharge cells, and the effective luminescence areas of the red and green discharge cells are the same.

17. The plasma display panel according to claim 15, wherein the effective luminescence area of the blue discharge cell is formed bigger than that of the red and green discharge cells, and the effective luminescence area of the red discharge cell is formed bigger than that of the green discharge cell.

18. A plasma display panel having a plurality of lower plate electrodes and a plurality of upper plate electrodes and having red, green and blue discharge cells arranged at intersections of the lower plate electrodes and the upper plate electrodes, the plasma display panel comprising:

barrier ribs partitioning off each of the discharge cells;

a first light-shielding layer formed along the barrier ribs, the width of the first light-shielding layer being different for different discharge cells; and a second light-shielding layer formed between adjacent discharge cells to cross the first light-shielding layer.

19. The plasma display panel according to claim 18, wherein the barrier ribs are formed parallel to the lower plate electrodes of the discharge cells, to which data are applied.

20. The plasma display panel according to claim 18, wherein the first light-shielding layer is formed, so that the effective luminescence area of at least any one of the red, green and blue discharge cells is made different from the luminescence area of at least another of the red, green and blue discharge cells.

21. The plasma display panel according to claim 20, wherein the effective luminescence area of the blue discharge cell is formed bigger than that of the red and green discharge cells, and the effective luminescence areas of the red and green discharge cells are the same.

22. The plasma display panel according to claim 20, wherein the effective luminescence area of the blue discharge cell is formed bigger than that of the red and green discharge cells, and the effective luminescence area of the red discharge cell is formed bigger than that of the green discharge cell.

23. A plasma display panel having a plurality of lower plate electrodes and a plurality of upper plate electrodes and having red, green and blue discharge cells arranged at intersections of the lower plate electrodes and the upper plate electrodes, the plasma display panel comprising:

barrier ribs partitioning off each of the discharge cells;

a first light-shielding layer formed along the barrier ribs in relation with the upper plate electrode, the width of the first light-shielding layer being different for different discharge cells; and a second light-shielding layer formed between adjacent discharge cells to cross the first light-shielding layer.

24. The plasma display panel according to claim 23, wherein the barrier ribs are formed parallel to the lower plate electrodes of the discharge cells, to which data are applied.

25. The plasma display panel according to claim 23, wherein the upper plate electrode includes:

a transparent electrode formed of transparent conductive material; and a bus electrode formed of a first and a second bus electrode material on the transparent electrode.

26. The plasma display panel according to claim 25, wherein the light-shielding layer and any one of the first and second bus electrode materials are simultaneously formed of the same material.

27. The plasma display panel according to claim 23, wherein the light-shielding layer is formed, so that the effective luminescence area of at least any one of the red, green and blue discharge cells is different from the luminescence area of at least another of the red, green and blue discharge cells.

28. The plasma display panel according to claim 27, wherein the effective luminescence area of the blue discharge cell is formed bigger than that of the red and green discharge cells, and the effective luminescence areas of the red and green discharge cells are the same.

29. The plasma display panel according to claim 27, wherein the effective luminescence area of the blue discharge cell is formed bigger than that of the red and green discharge cells, and the effective luminescence area of the red discharge cell is formed bigger than that of the green discharge cell.

* * * * *